US005170863A

United States Patent [19]

Devroy

[11] Patent Number: 5,170,863

[45] Date of Patent: Dec. 15, 1992

[54] METHOD AND APPARATUS FOR ACCELERATION AND DECELERATION CONTROL OF A STORAGE AND RETRIEVAL MACHINE

[75] Inventor: Craig A. Devroy, New Berlin, Wis.

[73] Assignee: Harnischfeger Engineers, Brookfield, Wis.

[21] Appl. No.: 729,765

[22] Filed: Jul. 15, 1991

[51] Int. Cl.[5] ..... B66B 9/20

[52] U.S. Cl. ..... 187/98; 414/279; 414/281

[58] Field of Search ..... 187/9 R, 9 E, 17, 26; 414/279, 284, 273, 281, 282

[56] References Cited

U.S. PATENT DOCUMENTS 3,542,161 11/1970 Ulinski ..... 187/9 E
4,252,217 2/1981 Benjamin ..... 187/9 R
5,022,496 6/1991 Klopfleisch et al. ..... 187/9 E

*Primary Examiner*—Robert P. Olszewski
*Assistant Examiner*—Kenneth Noland
*Attorney, Agent, or Firm*—Richard C. Ruppin

[57] ABSTRACT

A storage and retrieval machine having a base movable in opposite horizontal directions, a mast mounted on the base, and a carriage movable in opposite vertical directions on the mast. A drive is also provided for moving the base and carriage in their respective opposite horizontal directions or opposite vertical directions. A control is connected to the drive for transmitting to the drive for either the base or the carriage, a first signal for a fast acceleration rate in one of the opposite directions of movement, a second signal for a slow acceleration rate in the other of the opposite directions of movement, a third signal for a slow deceleration rate in one of the opposite directions of movement, a fourth signal for a fast deceleration rate in the other of the opposite directions of movement, and a direction signal to move in one of the opposite directions. The drive is responsive to the control to move either one of the base and carriage in their associated opposite directions of movement and accelerate and decelerate the base or carriage in accord with the respective acceleration and deceleration rate signals for the movement direction.

16 Claims, 4 Drawing Sheets

METHOD AND APPARATUS FOR ACCELERATION AND DECELERATION CONTROL OF A STORAGE AND RETRIEVAL MACHINE

FIELD OF THE INVENTION

This invention relates generally to the control of a storage and retrieval machine and in particular to a direction dependent acceleration and deceleration control for a storage and retrieval machine.

BACKGROUND OF THE INVENTION

Control systems for the automatic operation of storage and retrieval machines have, in recent years, become more comprehensive and sophisticated. This has increased the speed, accuracy and durability of storage and retrieval machines and opened the way for further developments which were not previously possible or even considered.

In present control systems for storage and retrieval machines, a remote control source gives an on-board control means a command to move to a particular storage location and either deliver or retrieve an object at the storage location. Either the remote control source or the on-board control means provides specific instructions for movement of the base, the carriage and the shuttle of the storage and retrieval means. The movemment instructions are utilized by further control and/or drive means to operate the base, carriage and shuttle to the necessary locations. The movement instructions include, e.g., distance to move or location to move to, maximum velocity, acceleration rate and deceleration rate, for both the base and the carriage. One or more of the instructions are aslo provided for the shuttle. Control systems at the level of sophistication provide a high degree of control over the entire operation of the storage and retrieval machine.

It has been recognized that factors such as the size and type of the load objects carried by the storage and retrieval machine affect the maximum velocity, the acceleration, and the deceleration at which the base and carriage can move. Present controls for storage and retrieval machines take such factors into account in providing movement instructions. The invention disclosed herein is an improvement to storage and retrieval machine controls and requires further that the direction of movement of the base and carriage be considered in providing either acceleration or deceleration instructions to the base and carriage.

SUMMARY OF THE INVENTION

It is an object of this invention to provide a control system for a storage and retrieval machine in which the acceleration and deceleration of the base and carriage of the storage and retrieval machine is dependent on the respective direction of travel of the base and carriage. It is a further object of this invention to utilize physical effects acting on the storage and retrieval machine which are movement direction dependent in controlling the acceleration and deceleration of the base and carriage of the storage and retrieval machine.

The objects of the invention are carried out in a storage and retrieval machine by providing a base movable in opposite horizontal directions, a mast mounted on the base, and a carriage movable in opposite vertical directions on the mast. A drive means is also provided for moving the base and carriage in their respective opposite horizontal directions or opposite vertical directions. Control means is connected to the drive means for transmitting to the drive means for either the base or the carriage, a first signal for a fast acceleration rate in one of the opposite directions of movement, a second signal for a slow acceleration rate in the other of the opposite directions of movement, a third signal for a slow deceleration rate in one of the opposite directions of movement, a fourth signal for a fast deceleration rate in the other of the opposite directions of movement, and a direction signal to move in one of the opposite directions. The drive means is responsive to the control means to move both the base and carriage in their associated opposite directions of movement and accelerate and decelerate the base or carriage in accord with the respective acceleration and deceleration rate signals for the movement direction.

BRIEF DESCRIPTION OF THE DRAWINGS

Further objects and advantages of the invention will appear when taken in conjunction with the accompanying drawings, in which.

DETAILED DESCRIPTION OF THE PREFERRED EMBODIMENT

Figure 1:
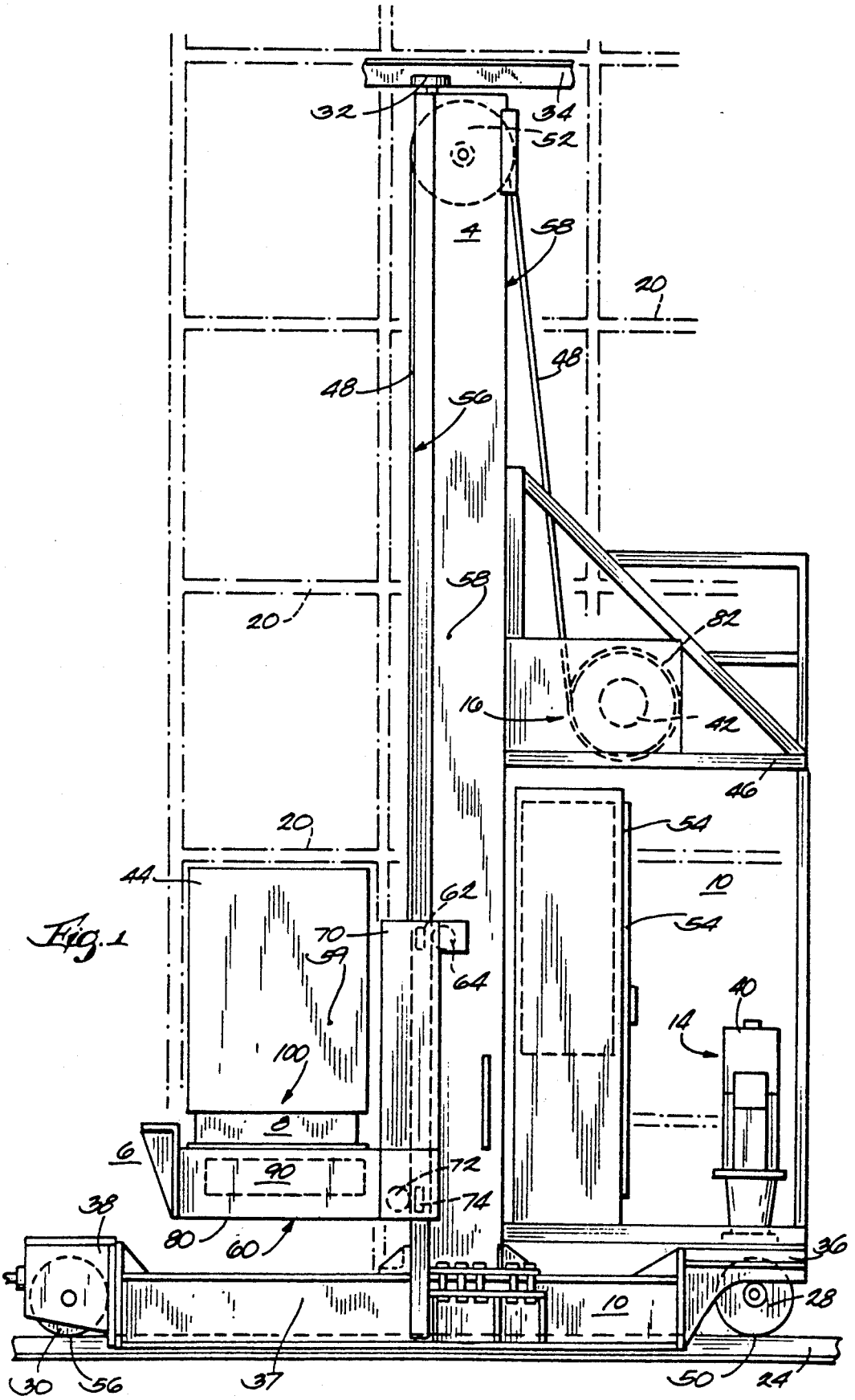
FIG. 1 is a side elevation view of a storage and retrieval machine incorporating the present invention.
Figure 2:
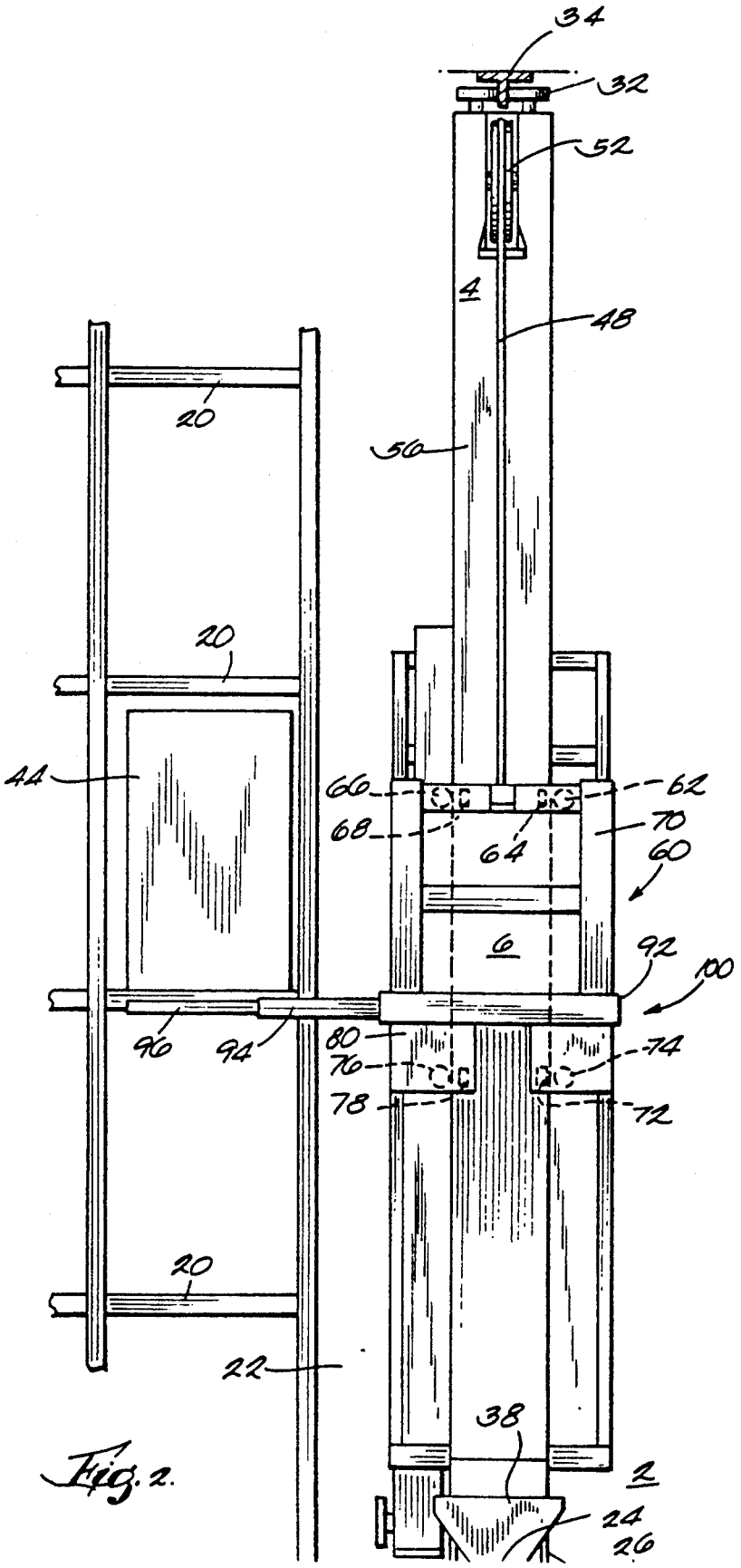
FIG. 2 is a front elevation view of the storage and retrieval machine illustrated in FIG. 1.

Referring generally to FIGS. 1–2 of the drawings, a storage and retrieval machine, which is also referred to herein as an SRM, is shown as having a base 2, a mast 4 mounted on and extending upwardly from the base, a carriage 6 movable vertically on a path along the length of the mast 4 to selected vertical locations, a shuttle 8 mounted on the carriage 6, a base and carriage drive means 10 and a control system 12. The base 2 has a length 37 including opposite ends 36 and 38. A drive wheel 28 rotating about an axis 50 and an idler wheel 30 rotating about an axis 56 comprise part of the drive means 10 and are respectively mounted on the ends 36 and 38 of the base 2 and roll along a rail 24 supported on a foundation 26 and running through an aisle path 22. The aisle path 22 extends through a storage area such as a warehouse having stacked storage racks 20. Upper guide wheels 32 on the mast 4 engage a guide rail 34 to guide the SRM along the rail 24 and maintain the machine in an upright position.

The drive means 10 also includes a base drive 14 mounted on the base 2 and having a motor 40. The motor 40 is connected to and drives the drive wheel 28 so that the base 2 and thereby the SRM travel in selected opposite directions horizontally and in the direction of the length of the base along the rail 24 to selected locations in the aisle path 22 adjacent to the stacked storage racks 20. At each aisle location of the SRM the carriage 6 is driven in one of opposite vertical directions to a selected one of the storage racks 20 where the shuttle 8 is driven generally horizontally and in directions transverse to the aisle path 22 into a storage rack to deliver or retrieve a load object such as box 44 carried on the shuttle as shown in FIGS. 1 and 2. The drive means 10 further includes a carriage drive 16 including a carriage motor 42 connected to and acting through a rope drum assembly 82 to drive the carriage 6. The motor 42 and the rope drum assembly 82 are both mounted on a frame 46 which comprises part of the base 2. A carriage driving rope 48, which is part of the assembly 82, is reeved over a sheave 52 on the mast 4 and connected to the carriage 6. A cabinet 54 is also mounted on the base 2 for enclosing a portion of the components of the control system 12. Suitable means (not shown) is provided for supplying electrical power for the various drives and the control system 12 of the SRM described hereinafter.

The carriage 6 includes a frame 60 upon which the shuttle 8 is mounted and to which is connected the rope 48 for moving the carriage 6 vertically along the mast 4 in response to the operation of the carriage motor 42 and the rope drum assembly 82. The carriage 6 is movably supported and guided on the mast 4 by means of upper support rollers 62, 64 and 66, 68 rotatably mounted on an upper section 70 of the frame 60, and by means of lower support rollers 72, 74, and 76, 78 rotatably mounted on a lower section 80 of the frame 60.

The shuttle 8 comprises a shuttle drive means 90 mounted on the lower section 80 of the carriage frame 60, a lower base plate 92 also mounted on the lower frame section 80, an intermediate plate 94, a top plate 96, and a shuttle telescoping drive 100. Operation of the shuttle telescoping drive 100 by the shuttle drive means 90 causes the plates 94 and 96 to extend in a telescoping fashion to the position shown in FIG. 2 and retract to a centered position on the lower frame section 80 relative to the view of FIG. 2. The shuttle 8 thus operates in conjunction with the base 2 and carriage 6 to deposit in or retract from a storage rack 20, the load object 44.

Figure 3:
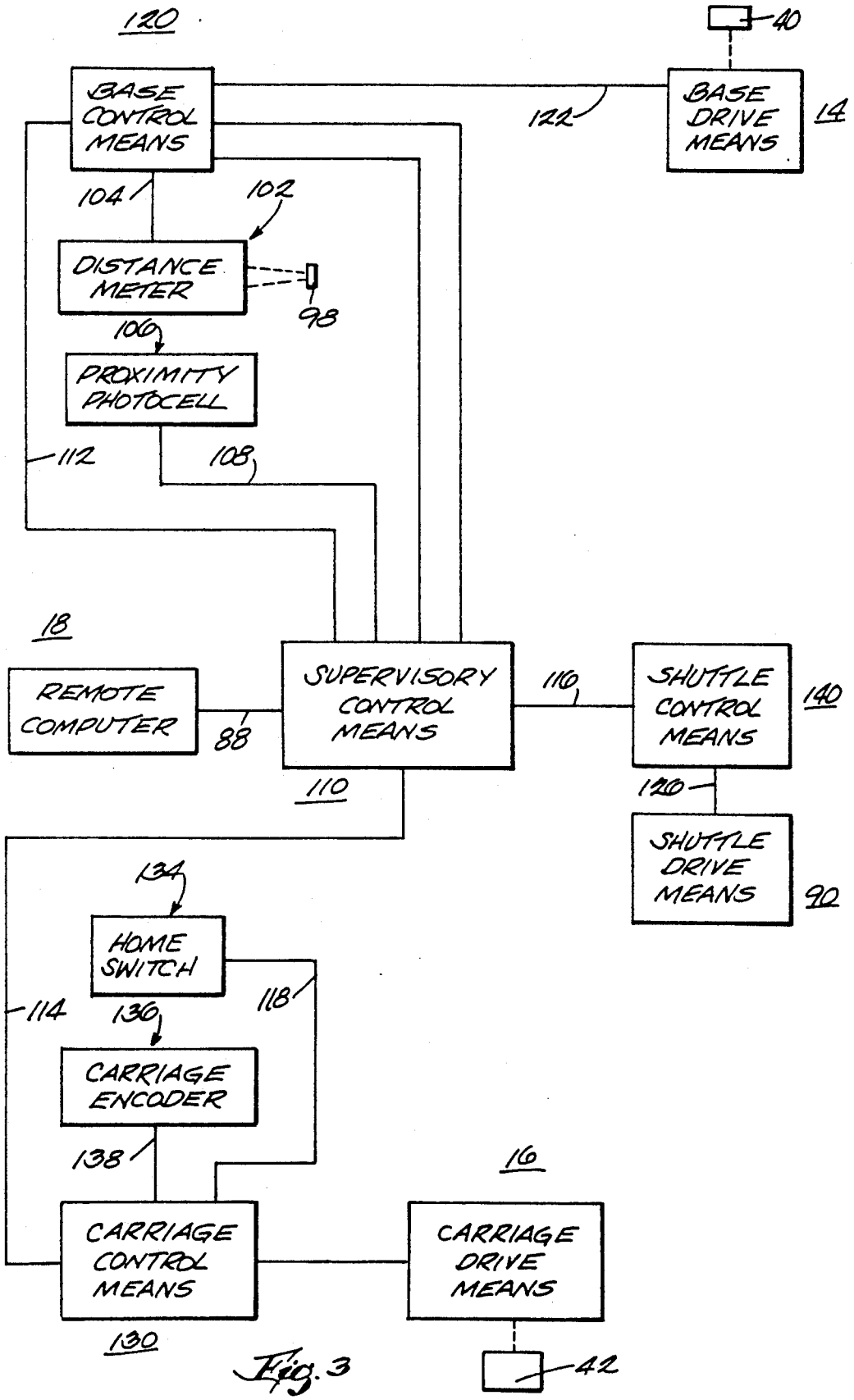
FIG. 3 is a schematic circuit diagram for the storage and retrieval machine shown in FIGS. 1 and 2 in which the present invention is incorporated.

The control system 12 is illustrated in greater detail in FIG. 3 and includes a supervisory control means 110 which receives operating command information on lines 88 from a remote computer 18, a base control means 120 for controlling the movement of the base 2 of the SRM along a path of travel in the aisle path 22, a carriage control means 130 for controlling the movement of the carriage 6 along a path of travel on the mast 4, and a shuttle control means 140 for controlling the extending and retracting movement of the shuttle 8 into and out of a storage rack 20. The supervisory control means 110 has a connection to the base control means 120, the carriage control means 130 and the shuttle control means 140 respectively represented by lines 112, 114 and 116.

The base control means 120 includes a distance meter 102 connected by a line 104 to the base control means 120, a reflector 98 located at the end of the aisle path 22, and a proximity photocell 106 connected to the supervisory control means 110 by a line 108. The carriage control means 130 includes a carriage encoder 136 connected to the control means 130 by a line 138, and a home switch 134 connected to the supervisory control means 110 by a line 118.

The supervisory control means 110 may, for example, comprise a programmable logic controller which is programmed to produce specific operating instructions to the base control means 120, the carriage control means 130 and the shuttle control means 140 in response to the operating commands from the remote computer 18. The operating information from the remote computer 18 is normally a command to the pick up or deposit a load object 44 or to move to a specified location. The information from the remote computer 18 is converted to RS232C format form and is then converted to a memory block of ASCII characters in binary code form at an input module of the supervisory control means 110. The supervisory control means 110 also has various discrete inputs for receiving operating condition indications relating to the base 2, carriage 6 and shuttle 8 and their associated controls. These include an input on the line 108 from the proximity photocell 106 indicating the location of the base 2 along the aisle path 22, an input on line 118 from the home switch 134 indicating whether the carriage 6 is at its reference home position, and inputs (not shown) indicating the position of and the full or empty condition of the shuttle. The supervisory control means 110 produces control instructions in response to not only the operating commands received from the remote computer 18, but also in accord with the discrete inputs relating to the base 2, carriage 6 and shuttle 8, and associated controls.

The base control means 120, carriage control means 130 and shuttle control means 140 each contain a program and the respective parameters of the associated base, carriage and shuttle which the control means 120, 130 and 140 control and which enable movement operation of the base 2, carriage 6 and shuttle 8 at optimum acceleration, deceleration and velocity values. These parameters include the reference positions of the carriage and shuttle, the velocity, acceleration and deceleration rates of the base and carriage, and the deceleration rate of the shuttle. With respect to the base 2, it is most efficiently accelerated and decelerated by using a different acceleration rate for movement in each of the opposite movement directions of the base as it moves along the aisle path 22 and using a different deceleration rate for movement of the base in each of these opposite directions. This is the case because the moment forces of apparatus carried by the SRM such as the mast, carriage and any load object carried by the carriage during acceleration and deceleration of the base are not equally applied to the wheels so that the base drive means 14 does not apply drive force equally to the wheels mounted on the base. With reference to FIG. 1, the wheel 28 is positioned toward or adjacent to the end 36 of the base 2 and is the only wheel driven to move the SRM along the rail 24. The wheel 30 is positioned toward or adjacent to the end 38 of the base 2 and is an undriven or idler wheel. The forces or load acting on the wheels 28 and 30 against the rail 24 due to acceleration or deceleration include the weight of the mast 4, the carriage 8 and any load object 44 that it may be carrying, and the weight of the other apparatus mounted on the SRM, all acting through moment arms extending from the center of gravity of each apparatus to fulcrum points 50 and 56 respectively at the engagement points of the drive wheel 28 and the idler wheel 30 with the rail 24. In FIG. 1, the center of gravity of the mast 4 and the center of gravity of the carriage 8 and load object 44 together are respectively identified by the numbers 58 and 59. When the base 2 is accelerated to move it along the aisle path 22 in a direction from the end 36 of the base toward the end 38, the moments of mast, carriage and other apparatus carried by the base each have a component force or load acting downward through the wheel 28 to increase the level of vertical force or load on the drive wheel 28 against the rail 24 compared to the force acting on the wheel 28 to hold it against the rail 24 when the base 2 is not accelerating. The result of the increased force of the drive wheel 28, considered with the coefficient of friction between the wheel 28 and the rail 24, is increased traction which permits a faster drive means acceleration rate for the base. When the base 2 is accelerating to move along the rail aisle path 22 in the direction from the end 38 toward the end 36 of the base, the level of the vertical component forces or loads of the moments of the mast 4, carriage 6 and other apparatus carried by the base 2 due to the acceleration increase the downward vertical force on load of the idler wheel 30 and decrease the downward vertical force on load on the drive wheel 28 against the rail 24. The result of the decreased downward vertical force of the drive wheel is to decrease traction so that it is necessary to select a slower acceleration rate at which the drive means 14 accelerates the base to avoid slippage by the drive wheel. In a similar manner, when the base 2 is moving in a direction on the rail 24 from the end 36 toward the end 38 and is decelerating, vertical components of the moments of the mast, carriage and other apparatus carried by the base act to decrease the level of downward vertical force applied to the drive wheel 28 to hold it against the rail 24. Due to the resulting decreased traction of the drive wheel, the base in deceleration is selected at a slower rate. When the base 2 is decelerating as it moves in a direction from the end 38 toward the end 36 of the base, the vertical moment force of load components of the apparatus carried by the base act to increase the downward vertical force of the drive wheel 28 on the rail 24 to increase drive wheel traction and enable selection and faster deceleration rate.

Figure 4:
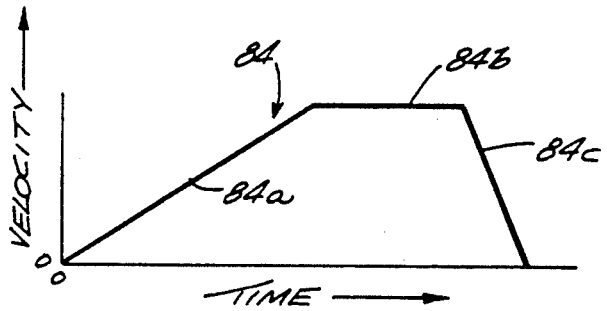
FIG. 4 is a graph of velocity with respect to time of the movement of the base of the storage and retrieval machine during travel in one of its opposite directions of movement.
Figure 5:
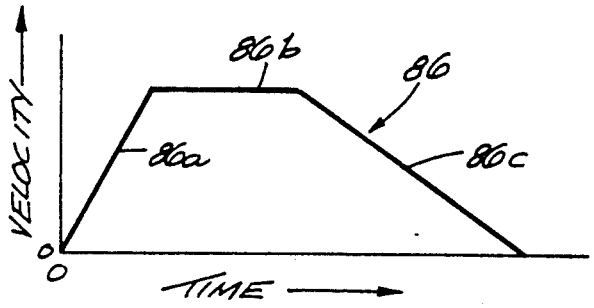
FIG. 5 is a graph of velocity with respect to time of the movement of the base of the storage and retrieval machine during travel in a direction opposite to that of FIG. 4.

With respect to FIGS. 4 and 5, FIG. 4 is a curve 84 of velocity with respect to time illustrating the movement of the base 2 along the aisle path 22 in a horizontal direction from the end 38 toward the end 36 of the base. The curve 84 has a section 84 *a* as the base begins movement from zero velocity and accelerates toward maximum velocity, a section 84 *b* along a maximum velocity and zero acceleration portion of the movement, and a section 84 *c* along a decelerating portion of the movement as the base decelerates from maximum velocity to zero speed at a designated instructed new position of the base. The acceleration portion 84 *a* of the base movement is at a slow acceleration value since the moment force components of the loads carried by the base decrease the amount of force on the drive wheel 28 thereby decreasing the drive force which the wheel 28 can apply to the rail 24 to enable acceleration. On the other hand, as the base moves in the direction from its end 36 towards its end 36 and decelerates, the deceleration rate is faster as shown by portion 84 *c* of the curve 84 due to increased drive force by the drive wheel 28 as a result of the force components of the moments of the mast, carriage and other parts of the SRM acting on the wheel 28. Suitable acceleration and deceleration rates which may be selected for the base when moving in the direction shown in FIG. 4 are a slow acceleration rate of 3 ft./sec.$^2$. For the acceleration portion 84 *a* of the curve and a relatively rapid 6 ft./sec.$^2$ for the deceleration portion 84 *c* of the curve. However these acceleration and deceleration values are merely exemplary and depend on the physical characteristics of the SRM and the loads carried by the carriage. FIG. 5 is a curve 86 of velocity with respect to time illustrating the acceleration, velocity and deceleration of the base 2 of the SRM when moving along the aisle path 22 in a horizontal direction from the end 36 toward the end 38. As a result of the increased drive force of the wheel 28 on the rail 24 due to the increased force components of the moments of the mast, carriage and other SRM equipment on the wheel 28, the acceleration portion of the movement of the base, as shown by the curve section 86 *a* has a relative rapid acceleration rate. Following the reaching of the maximum velocity of the base, as shown by the curve portion 86 *b*, the base 2 decelerates at a relatively slow rate as shown by the curve section 86 *c*, due to the decreased force component of the moments of the apparatus carried by the base on the wheel 28. The acceleration and deceleration rates selected for the base when moving in the direction from the end 36 toward the end 38 may be the same or different than the corresponding acceleration and deceleration rates when moving in the opposite direction, depending on the physical characteristics of the SRM and the load objects 44 carried. However, exemplary values for curve sections 86 *a* and 86 are 6 ft./sec.$^2$ and 3 ft./sec.$^2$, respectively.

Figure 6:
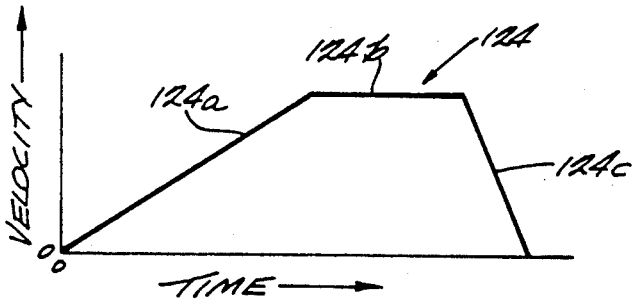
FIG. 6 is a graph of the velocity with respect to time of the movement of the carriage of the storage and retrieval machine during movement in an upward direction.
Figure 7:
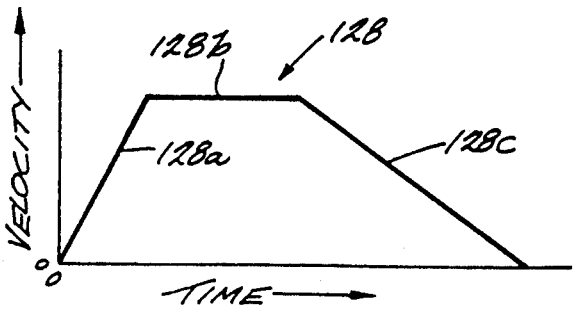
-and FIG. 7 is a graph of the velocity with respect to time of the movement of the carriage of the storage and retrieval machine during movement in a downward direction.

With reference to the carriage 6, its acceleration and deceleration when moving in an upward direction and acceleration and deceleration when moving in a downward direction will vary due to the force of gravity acting on the carriage and the load object it carries. When the carriage 6 moves in an upward direction on the mast from zero velocity, it is controlled to move at a selected relatively slow acceleration rate due to the force of gravity acting downwardly on the carriage and its load. However, when moving in an upward direction, the carriage can be selectively decelerated relatively rapidly to zero velocity due to the force of gravity. FIG. 6 is a curve 124 of velocity with respect to time illustrating the movement of the carriage 6 in an upward direction. The section 124 *a* of the curve represents the upward acceleration portion of the movement of the carriage, the section 124 *b* represents a zero acceleration and maximum velocity portion of the carriage movement, and the section 124 *c* represents the rapid deceleration portion of the movement of the carriage. When moving in a downward direction along its vertical path on the mast, the carriage 6 rapidly accelerates due to the force of gravity from zero velocity and slowly decelerates, when stopping, to zero velocity due to the force of gravity. FIG. 7 is a curve 128 of velocity with respect to time illustrating the acceleration downward of the carriage, represented by curve section 128 *a*, the zero acceleration and maximum velocity portion of the crane movement, represented by curve section portion 128 *b*, and the deceleration portion from maximum velocity to zero velocity of the carriage, represented by curve section 128 *c*. When moving in an upward direction, the selected acceleration rate and deceleration of the carriage may respectively be 3 ft./sec.$^2$ and 6 ft./sec.$^2$. When moving in a downward direction, the selected acceleration rate and deceleration rate of the carriage may have reverse values of that when moving in an upward direction, i.e., a downward acceleration rate of 6 ft./sec.$^2$ and a downward deceleration rate of 3 ft./sec.$^2$. These values of acceleration and deceleration are exemplary and suitable acceleration and deceleration rates will vary depending on the weight of the carriage and the load object it carries, and the size and characteristics of the carriage drive means.

Referring again to the base and carriage control means 120 and 130, the parameters which they contain include the selected different acceleration and deceleration rates for the base when it is moving in its opposite horizontal directions and the different acceleration and deceleration rates for the carriage when it is moving in its opposite vertical directions.

The distance meter 102 of the base control means 120 transmits an infrared light beam along the aisle path 22 of travel of the base 2 toward the reflector 98 so that a reflected beam is returned to the distance meter 102 to provide a movement indication and distance measurement which locates the position of the base 2 along aisle path 22. Upon receipt of a control instruction on line 112 by the base control means 120 from the supervisory control means 110 requiring a movement of the base 2 along its path to a new position, the control means 120 will compare the new position to which the base is to travel with the base's current position as indicated by the distance meter 102. The means 120 also will concurrently select, on the basis of the direction in which the base is to travel, the acceleration rate, the maximum velocity to which the base can accelerate, and the deceleration rate as the base approaches the new position. As previously described, the selected acceleration and deceleration rates for travel in one of the directions of movement of the base 2 may differ from those selected for travel of the base in the opposite direction of movement. Upon selection of these values, the base control means 120 transmits appropriate instruction signals to the base drive means 14 for the control of the frequency of the variable frequency power to the base motor 40 to drive the base 2 in the correct direction at the selected maximum velocity and acceleration and deceleration rates to the new position. The instruction signals include direction, maximum velocity, fast acceleration rate and slow acceleration rate and fast deceleration rate signals for movement in the opposite direction.

During an initialization operation of the SRM, the carriage control means 130 is instructed by the supervisory control means 110 to move the carriage 6 to a home position. Movement of the carriage 6 to the home position will be indicated by the home switch 134 in a response to the control means 130. The home position of the carriage 6 is a reference position at which the count of the carriage encoder 136 provides a reference indication representing the reference position for all subsequent movements of the carriage and the carriage encoder. Upon receipt of a control instruction on line 114 to the carriage control means 130 from the supervisory control means 110 requiring a pick-up or deposit movement of the carriage 6 along its movement path, the control means 130 will compare the instructed new position as indicated by the carriage encoder 136. The control means 130 determines the maximum velocity of which the carriage is to travel and selects, upon the basis of the upward or downward direction in which the carriage is to move, the accleration rate and the deceleration rate upon approaching the new position. Upon determination of these values, the carriage control means 130 will transmit appropriate instruction signals to the carriage drive means 16 for the control of the frequency of the variable frequency power to the carriage motor 42 to drive the carriage 6 at the selected acceleration rate, velocity and deceleration rate to move the carriage 6 to the new position, the level of the vertical component forces or loads of the moments of the mast 4, carriage 6 and other apparatus carried by the carriage 2 due to the acceleration increase the downward vertical force on load of the idler wheel 30 and decrease the downward vertical force on load on the drive wheel 28 against the rail 24. The result of the decreased downward vertical force of the drive wheel is to decrease traction so that it is necessary to select a slower acceleration rate at which the drive means 14 accelerates the carriage base to avoid slippage by the drive wheel.

Also, after initialization of the SRM, a control instruction on line 116 to the shuttle control 25 means 140 from the supervisory control means 110 requiring a pick-up or deposit movement of the shuttle 8 will include the position to which the shuttle is to move and the acceleration and velocity of the shuttle in making the move. Following the movement of the carriage 6 to its instructed new position, the shuttle control means 140 will tranmit appropriate instruction signals to the shuttle drive means 90 for the control of the frequency of the variable frequency power to drive the shuttle 8 at the acceleration rate, velocity and deceleration rate to move the shuttle 8 to its new position to pick up or deposit a load object. Following the completion of the operation of the shuttle, the SRM will normally move to a new location to perform another retrieval or deposit operation in accord with a new command from the remote computer 18.

What is claimed is:

1. A method for control of a storage and retrieval machine having a base travelable in first and second opposite directions along a horizontal path, a mast mounted on the base, a carriage movable in first and second opposite directions on the mast along a vertical path, drive means for the base and carriage, and control means connected to the drive means, comprising the steps of:

operating the drive means to move one of the base and carriage means along its associated path in a first direction at a fast first acceleration rate and a slow first deceleration rate; and operating the drive means to move said one of the base and carriage means along its associated path in a second direction opposite to the first direction at a second acceleration rate slower than the first acceleration rate and a second deceleration rate faster than the first deceleration rate.

2. The method according to claim 1 wherein:

the step of operating the drive means in the first direction is accomplished by moving the carriage means in a downward direction at a fast first acceleration rate and at a slow first deceleration rate; and the step of operating the drive means in the second direction is accomplished by moving the carriage means in an upward direction at a slow second acceleration rate and at a fast second deceleration rate.

3. The method according to claim 1 in which the mast and the carriage comprise a load on the base which varies proportionately with the direction of movement and acceleration or deceleration rate of the base; and wherein the step of operating the drive means in the first direction is accomplished by moving the base means in the first direction at a fast first acceleration rate proportional to the load on the drive means when accelerating in the first direction and at a slow first deceleration rate proportional to the load on the drive means when decelerating in the first direction; and the step of operating the drive means in the second direction is accomplished by moving the base means in the second direction at a slow second acceleration rate proportional to the load on the drive means when accelerating in the second direction and at a fast second deceleration rate proportional to the load on the drive means when decelerating in the second direction.

4. A method for control of a storage and retrieval machine having a base movable in first and second opposite directions along a horizontal path, a mast mounted on the base, a carriage movable in first and second opposite directions on the mast along a vertical path, and drive means for the base and carriage, comprising the steps of:

selecting, for the base, a predetermined first base acceleration rate for movement of the base in the first horizontal direction, a predetermined second base acceleration rate different than the first base acceleration rate for movement of the base in the second horizontal direction, a predetermined first base deceleration rate of movement of the base in the first horizontal direction, and a predetermined second base deceleration rate different than the first base deceleration rate for movement of the base in the second horizontal direction;

operating the drive means to accelerate and decelerate the base along its path in the first horizontal direction respectively at the predetermined acceleration rate and the predetermined deceleration rate; and operating the drive means to accelerate and decelerate the base along its path in the second horizontal direction respectively at the predetermined second base acceleration rate and the predetermined second base deceleration rate.

5. The method according to claim 4 in which the drive means includes drive wheel means for supporting and moving the base along the first and second acceleration rates and the first horizontal path and wherein the selecting step is accomplished by selecting the first base acceleration and deceleration rates on the basis of the vertical forces on the drive wheel means during acceleration and deceleration of the base in said first and second directions.

6. The method according to claim 5 further comprising the step of:

positioning the drive wheel means on the base such that the drive wheel means is subjected to a first increased vertical force when the base is accelerated in the first direction, a first decreased vertical force when the base is decelerated in the first direction, a second decreased vertical force when the base is accelerated in the second direction, and a second increased vertical force when the base is decelerated in the second direction; and wherein the selecting step includes;

selecting the first base acceleration rate in proportion to the first increased vertical force, the first base deceleration rate in proportion to the first decreased vertical force, the second base acceleration rate in proportion to the second decreased vertical force, and the second base deceleration rate in proportion to the second increased vertical force.

7. The method according to claim 6 in which the drive wheel means comprises a single drive wheel and wherein the step of positioning the drive wheel means is accomplished by positioning the single drive wheel adjacent an end of the base.

8. A method for control of a storage and retrieval machine having a base travelable along a horizontal path, a mast mounted on the base and carriage, a carriage movable in first and second opposite vertical directions on the mast, and drive means for the base and carriage comprising the steps of:

selecting, for the carriage, a predetermined first carriage acceleration rate for movement of the carriage in the first vertical direction, a predetermined second carriage acceleration rate different than the first carriage acceleration rate for movement of the carriage in the second vertical direction, a predetermined first carriage deceleration rate for movement of the carriage in the first vertical direction, and a predetermined second carriage deceleration rate different than the first carriage deceleration rate for movement of the base in the second vertical direction;

operating the drive means to accelerate and decelerate the carriage in the first vertical direction respectively at the predetermined first carriage acceleration rate and the predetermined first carriage deceleration rate; and operating the drive means to accelerate and decelerate the carriage in the second vertical direction respectively at the predetermined second carriage acceleration rate and the predetermined second carriage deceleration rate.

9. The method according to claim 8 wherein the step of selecting carriage acceleration and deceleration rates is accomplished by selecting acceleration and deceleration rates proportional to the affect of gravity on the carriage means.

10. In a storage and retrieval machine having a base movable in opposite directions along a horizontal path, a mast mounted on the base, and a carriage movable in opposite directions along a vertical path on the mast, the combination comprising:

drive means for moving the base and carriage along their respective paths in either of the opposite directions of movement associated with the base and carriage;

control means connected to the drive means for transmitting to the drive means a first signal for a fast acceleration rate in one of the opposite directions of movement, a second signal for a slow acceleration rate in the other of the opposite directions of movement, a third signal for a slow deceleration rate in one of the opposite directions of movement, a fourth signal for a fast deceleration rate in the other of the opposite directions of movement, and a direction signal to move in one of the opposite directions; and the drive means is responsive to the control means to move one of the base and carriage in one of their associated opposite directions of movement and accelerate and decelerate the one of the base and carriage in accord with the respective acceleration and deceleration rate signals for the movement direction.

11. The combination according to claim 10 wherein:

the drive means includes a base drive means mounted on the base;

the storage and retrieval machine comprises a load on the base drive means including a vertical moment load component during acceleration and deceleration of the base; and the fast and slow acceleration rates and the fast and slow deceleration rates each have selected values proportional to the vertical moment load component and dependent on the direction of movement of the base.

12. The combination according to claim 10 wherein:

the drive means includes a base drive means mounted on the base;

the mast and carriage comprise a load on the base drive means including a vertical moment load component during acceleration and deceleration of the base;

the base drive means has a highly loaded condition in response to the vertical moment load component when the base is accelerated in said one of the opposite directions of horizontal movement such that the base is responsive to the first signal to rapidly accelerate;

the base drive means has a lightly loaded condition in response to the vertical moment load component when the base is accelerated in the other of the opposite directions of horizontal movement such that the base is response to the second signal to slowly accelerate;

the base drive means has a lightly loaded condition in response to the vertical moment load component when the base is decelerated in said one of the opposite directions of movement such that the base is responsive to the third signal to slowly decelerate; and the base drive means has a highly loaded condition in response to the vertical moment load component when the base is decelerated in said one of the opposite directions of movement such that the base is response to the fourth signal to rapidly decelerate.

13. The combination according to claim 11 wherein:

the base has a length extending in its opposite directions of movement and includes first and second opposite ends;

the base drive means includes a single drive wheel rotatably mounted on the base means adjacent the first of the ends; and the vertical moment load component comprises a load on the drive wheel.

14. The combination according to claim 13 wherein:

said one of the opposite directions of movement is from the first end toward the second end of the base, such that acceleration of the base in said one of the opposite directions of movement subjects the first end of the base and the drive wheel to a high load and traction condition to enable the drive means to accelerate the drive wheel at a rapid rate in response to the fast acceleration rate signal, and such that deceleration of the base in said one of the opposite directions of movement subjects the first end of the base and the drive wheel to a light load and traction condition to permit the drive means to decelerate the drive wheel at a slow rate in response to the slow deceleration rate signal; and said other of the opposite directions of movement is from the second end toward the first end of the base, such that acceleration of the base in said other of the opposite directions of movement subjects the first end of the base and the drive wheel to a light load and traction condition to permit the drive means to accelerate the drive wheel at a slow rate in response to the slow acceleration rate signal, and such that deceleration of the base in said other of the opposite directions of movement subjects the first end of the base and the drive wheel to a high load and traction condition to enable the drive means to decelerate the drive wheel at a fast rate in response to the fast deceleration rate signal.

15. The combination according to claim 10 wherein:

the drive means includes a carriage drive means subject to the force of gravity in its movement in opposite directions along the vertical path on the mast; and the control means is connected to the carriage drive means for transmitting a fast acceleration rate signal to the carriage drive means for movement of the carriage means in a downward direction, a slow acceleration rate signal to the carriage drive means for movement of the carriage means in an upward direction, a slow deceleration rate signal to the carriage drive means for movement of the carriage means in a downward direction, and a fast deceleration rate signal to the carriage drive means for movement of the carriage means in an upward direction.

16. The combination according to claim 10 wherein the drive means includes a carriage drive means subject to the force of gravity in its movement in upward and downward directions along the vertical path on the mast such that the acceleration of the carriage in a downward direction is increased by the force of gravity to enable the drive means to accelerate the carriage at a rapid rate in response to the fast acceleration rate signal, and such that the acceleration of the carriage in an upward direction is decreased by the force of gravity to permit the drive means to accelerate the carriage at a slow rate in response to the slow acceleration rate signal.

* * * * *